US011806990B2

(12) United States Patent
Magnusson et al.

(10) Patent No.: US 11,806,990 B2
(45) Date of Patent: Nov. 7, 2023

(54) SIGNALS CONTROLLERS

(71) Applicant: Hewlett-Packard Development Company, L.P., Spring, TX (US)

(72) Inventors: Daniel James Magnusson, Vancouver, WA (US); Robert Yraceburu, Vancouver, WA (US); Timothy Jacob Luedeman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 129 days.

(21) Appl. No.: 17/294,033

(22) PCT Filed: Dec. 21, 2018

(86) PCT No.: PCT/US2018/067226
§ 371 (c)(1),
(2) Date: May 14, 2021

(87) PCT Pub. No.: WO2020/131111
PCT Pub. Date: Jun. 25, 2020

(65) Prior Publication Data

US 2022/0009250 A1 Jan. 13, 2022

(51) Int. Cl.
*B41J 11/00* (2006.01)
*B41J 2/045* (2006.01)

(52) U.S. Cl.
CPC ..... *B41J 11/00242* (2021.01); *B41J 2/04541* (2013.01); *B41J 2/04563* (2013.01); *B41J 11/00212* (2021.01)

(58) Field of Classification Search
CPC ..... B41J 11/009; B41J 11/002; F26B 21/10
See application file for complete search history.

(56) References Cited

U.S. PATENT DOCUMENTS

| | | | | |
|---|---|---|---|---|
| 5,600,528 | A * | 2/1997 | McQueen | G01F 23/246 361/103 |
| 7,104,644 | B2 * | 9/2006 | Sugaya | B41J 11/009 347/14 |
| 9,671,799 | B2 | 6/2017 | Krueger | |
| 2017/0160678 | A1 | 6/2017 | Portnoy et al. | |
| 2017/0332676 | A1 | 11/2017 | Minvielle et al. | |
| 2018/0099511 | A1 * | 4/2018 | Yraceburu | F26B 21/10 |
| 2018/0106686 | A1 * | 4/2018 | Furtner | G01K 7/16 |
| 2018/0236788 | A1 | 8/2018 | Luedeman et al. | |

FOREIGN PATENT DOCUMENTS

| | | | |
|---|---|---|---|
| CN | 1801026 | A | 7/2006 |
| CN | 202033675 | U | 11/2011 |
| CN | 105138040 | A | 12/2015 |
| CN | 105827172 | A | 8/2016 |
| CN | 106444899 | A | 2/2017 |
| CN | 106814605 | A | 6/2017 |

* cited by examiner

*Primary Examiner* — Lam S Nguyen
(74) *Attorney, Agent, or Firm* — Brooks, Cameron & Huebsch, PLLC

(57) ABSTRACT

In some examples, a system can include: a heating device, a Proportional Integral Derivative (PID) controller and a switching mechanism to selectively enable transmission of signals to the heating device based on a real time temperature in proximity to the heating device, wherein the PID controller is to continuously output pulse width modulation (PWM) signals independent of selective transmission of signals by the switching mechanism.

8 Claims, 4 Drawing Sheets

SIGNALS CONTROLLERS

BACKGROUND

Imaging devices, such as printers and scanners, may be used for transferring print data on to a medium, such as paper. The print data may include, for example, a picture or text or a combination thereof and may be received from a computing device. The imaging device may generate an image by processing pixels each representing an assigned tone to create a halftone image.

DETAILED DESCRIPTION

Figure 1:
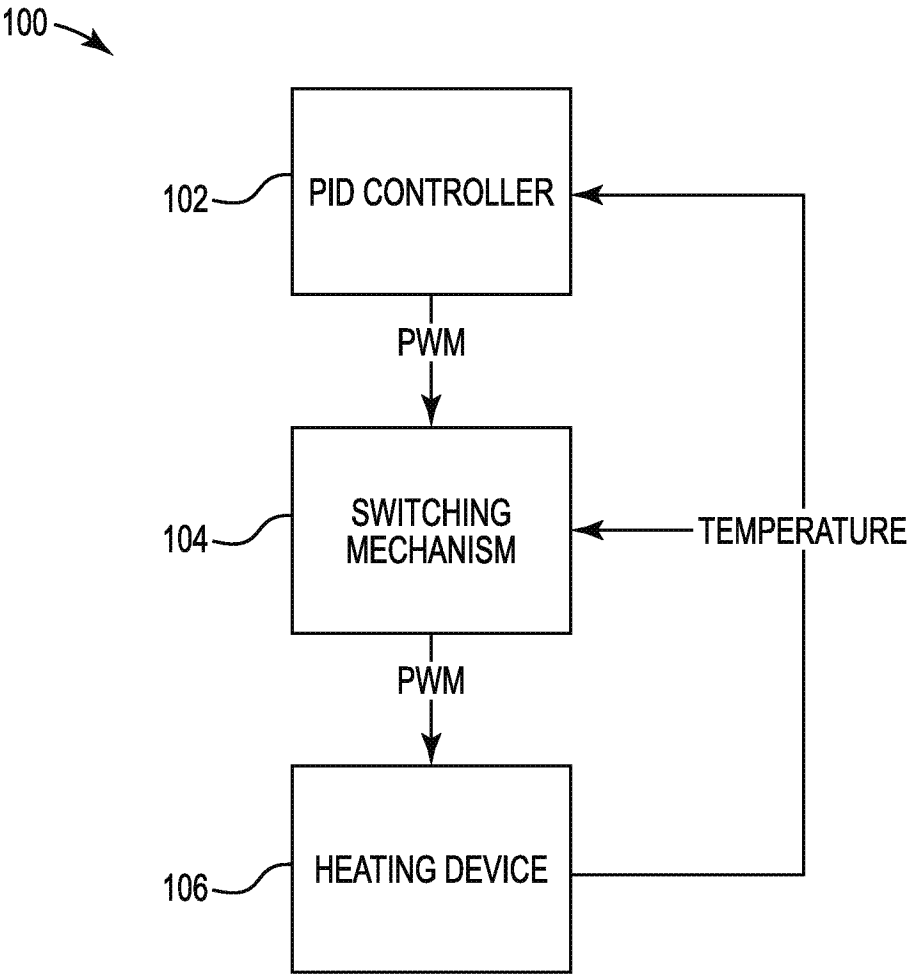
FIG. 1 illustrates a system according to an example.

In some examples, an imaging system can include an inkjet printing device. In some examples, the inkjet printing device can deposit quantities of a print substance on a physical medium. In some examples, the print substance can create a curl, and/or cockle in the physical medium when the print substance deposited on the physical medium is not completely dry. In some examples, a number of physical properties of the physical medium can be changed when the print substance is deposited by the imaging system. For example, the stiffness of the physical medium can be changed when the print substance includes fluid droplets. In some examples, the physical medium with deposited print substance that is not completely dry can be referred to as partially dried media.

The curl, cockle, and/or other physical properties that change due to the print substance can make finishing processes difficult. As used herein, a finishing process can include a process performed by the imaging system or finisher device after the print substance is deposited on the physical medium. The partially dried media can provide difficulties when stacking, aligning, and/or finishing. For example, the partially dried media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the physical medium and the physical medium absorbing the printing fluid. For example, the print substance can be in a liquid state that can be absorbed by a physical medium such as paper. In this example, the liquid state of the print substance can cause the distorted properties of the partially dried media in a similar way that other liquids may distort the properties of the physical medium.

In some examples, a drying zone of an imaging device can be utilized to remove or reduce the liquid and/or distorted properties from the partially dried inkjet media. The drying zone can include, but is not limited to, a number of air flow devices, pressure rollers, heated rollers, and/or heated pressure rollers. In some examples, a heated pressure roller of the drying zone can be utilized to remove or reduce the distorted properties from the physical medium or partially dried medium. For example, the heated pressure roller can be utilized to apply pressure to a surface of the partially dried media and apply heat to the surface of the partially dried media. In this example, the applied heat and pressure can remove or substantially remove the distorted properties of the partially dried media.

In some examples, the drying zone or a component of the drying zone can include a heat source (e.g., heat generating device, halogen lamp, etc.) that can be utilized to increase a temperature of the drying zone and/or a device within the drying zone, such as a heated pressure roller. For example, the heat source can include a halogen lamp that can generate heat within a belt roller of a heated pressure roller system. In some examples, the heat source can utilize a set point temperature for a particular print job. As used herein, the set point temperature can be a temperature that is set for a particular print job to remove or reduce potential distorted properties caused by depositing a print substance on the print media.

The set point temperature can be based on a quantity of print substance deposited on the print media. For example, a first print job with a first quantity of print substance deposited on a print media can utilize a first set point temperature to remove or reduce distorted properties and a second print job with a second quantity of print substance deposited on the print media can utilize a second set point temperature. By way of example, a greater quantity of print substance deposited on the print media can correspond to a greater set point temperature. Thus, when the first quantity of print substance is greater than the second quantity of print substance, the first set point temperature can be greater than the second set point temperature. In other examples, when there is a greater quantity of print substance, the rotational speed of the heated pressure roller and/or the speed of print media passing through the heated pressure roller can be altered to accommodate for the greater quantity of print substance. In some examples, the speed of the print job can be adjusted, and the set point temperature can be adjusted proportionally. Of course, in other cases, the set point temperature may remain stable in spite of print substance quantity and the like.

At times, print substances may alter the temperature of a heat source (e.g., the temperature of a heated pressure roller may decrease as it contacts print substances). It may be challenging, therefore, to maintain the temperature of a heat source at a set point temperature, and significant fluctuations in heat source temperature may yield undesirable results (e.g., insufficient conditioning of partially dried media, component damage, etc.). One approach to maintaining temperature may include using a control system with a feedback loop (e.g., a proportional-integral-derivative (PID) controller). As used herein, a feedback loop includes receiving a system output, such as a current temperature of a drying zone and updating an input, such as a signal, to alter the system output toward a particular state, such as a set point temperature of the drying zone. It may be difficult to use such a control system by itself to maintain a reasonably small temperature range about a set point due to long control loop cycle times utilized to be complaint with regulatory rules. In some cases, shorter control loop cycle times can be utilized, but can be costly as electrical filter components would also be utilized to be compliant with regulatory rules. In some examples, therefore, each set point temperature associated with a print job can have a corresponding threshold. In addition, a threshold can be a particular temperature that may be used to trigger an event. For example, in one case, exceeding or falling below a threshold can lead to disabling and/or enabling power to a heat source. As described herein, to disable power transmission, such as power transmission being allocated (e.g., distributed) by use of Pulse Width Modulated (PWM) signals, refers to keeping power from reaching a device (e.g., a heat source) that has exceeded an upper limit of a threshold temperature. As described herein, to enable power transmission, such as power transmission being allocated by use of PWM signals, refers to allowing power to reach a device (e.g., a heat source), such as while the device temperature is at a set point temperature and/or falls below a temperature threshold. In some examples, in addition to having upper and lower thresholds, there may be intermediate thresholds (e.g., above the set point but below an upper threshold, below the set point but above a lower threshold, etc.).

While a controller can generally maintain temperature within established thresholds about a set point and usually avoid significant variations or temperature swings, at times, there may nevertheless be delays in system responses. The delay in system responses may be due to long control loop cycle times that may be associated with some controllers, such as a PID controller. Additionally, the results of delayed system response, or lag, may be particularly acute in print devices with high throughput (e.g., 60 pages per minute (ppm), 80 ppm, 100 ppm, etc.) as the system may have difficulty in maintaining heat source temperature within thresholds, such as without significant temperature drops and/or spikes. One approach for potentially reducing delay or lag-induced effects may include using a switching mechanism, such as a switching mechanism based on asymmetric hysteresis. Using a system with a PID controller by way of illustration (but not limitation), the switching mechanism may be capable of selectively transmitting signals (e.g., power, power signals, control signals, etc.) to a heat source. For instance, a switching mechanism (e.g., in the form of a hardware, software, firmware, or combination thereof) may be used to detect a heat source exceeding an upper threshold (e.g., 125° C.) about a temperature set point (e.g., 110° C.), and the switching mechanism may responsively disable transmission of power to the heat source without disabling operation of the PID controller. Additionally, the switching mechanism may be able to responsively enable transmission of power to the heat source upon a determination that the temperature has fallen below an additional threshold (e.g., 120° C.). By way of example, it may be advantageous for the PID controller to remain operational, such as while the switching mechanism has disabled power transmission to the heat source, such as to take advantage of the feedback loop (e.g., in determining an error value between a measured temperature and a set point, etc.). As noted, the hysteresis-based switching mechanism may be asymmetric (e.g., one sided), such as restricting selective enabling and/or disabling of power transmission to a heat source based on temperature fluctuations about an upper threshold (e.g., 125° C.), but not a lower threshold (e.g., 100° C.), by way of example.

One implementation comprising a switching mechanism (e.g., an asymmetric hysteresis-based switching mechanism) capable of selectively enabling transmission of signals (e.g., power, power signals, etc.) to a heat source is illustrated in FIG. 1. FIG. 1 illustrates an example system 100 including a heating device 106, a PID controller 102, and a switching mechanism 104. In some examples, the switching mechanism 104 can be a second controller, a hysteresis-based switching component, a TRIAC device, and/or other type of device that can switch between a plurality of states (e.g., enabled state, disabled state, etc.). As noted above, a hysteresis-based switching component can be a switching mechanism that can utilize hysteresis to filter signals so that it reacts less rapidly (e.g., avoiding resonating control situations that can lead to temperature overshoots and/or temperature droop and/or flicker), such as by taking historic temperatures into account. For example, the hysteresis-based switching component can be asymmetric relative to a setpoint temperature of the imaging device. As used herein, a TRIAC device can include a three-electrode semiconductor device that can conduct in either direction when triggered by a positive or negative signal at a gate electrode.

In some examples, the switching mechanism 104 can selectively enable transmission of signals (e.g., power, power signals, etc.) to the heating device based on a real time temperature in proximity to the heating device. In some examples, the PID controller 102 is to continuously output pulse width modulation (PWM) signals independent of selective transmission of signals by the switching mechanism 104. As described herein, a real time temperature is a measurement of an actual temperature of the heating device 106. In some examples, the system 100 can include a temperature monitor to determine the real time temperature and send the real time temperature to the switching mechanism 104 and the PID controller 102.

In some examples, the switching mechanism 104 can be communicatively coupled to the PID controller 102, and the heating device 106 (e.g., heat source, heated pressed roller, etc.). As used herein, communicatively coupled includes a physical or wireless connection that can be utilized to transmit and/or receive communication signals, electrical signals, and/or electrical power. In some examples, a rate of temperature increase of heating device 106 can correspond to a numerical value representative of PWM signals generated by the PID controller 102. For example, as PWM signals generated by the PID controller 102 increase in magnitude, an amount of heat applied by the heating device 106 can increase. This, in turn, can lead to an increase in temperature of heating device 106 at a relatively higher rate compared to a comparatively lower PWM signal (e.g., prior to increases). The switching mechanism 104 can, via a temperature sensor, monitor temperature of the heating device 106, determine whether the temperature exceeds a threshold temperature, and selectively enable transmission of signals to a heating element (e.g., power, power signals, control signals, etc.) based on the real time temperature in proximity to the heating device 106.

The signals received by the PID controller 102 (e.g., temperature signals) can be directly proportional to the temperature of the heating device 106. In some examples, if the temperature of the heating device 106 increases, the signals received by the PID controller 102 can increase. In some examples, if the temperature of the heating device 106 decreases, the signals received by the PID controller 102 can decrease. In some examples, the switching mechanism 104 can be communicatively coupled to a temperature sensor that is utilized to monitor the temperature of the heating device 106.

In some examples, the switching mechanism 104 can make and/or break the connection in a circuit (e.g., electric circuit). In some examples, the switching mechanism 104 can be a physical switch, a logical switch (e.g., using firmware and/or software), or a combination thereof. In some examples, the switching mechanism 104 can break and/or disable an electric connection if the temperature of the heating device 106 exceeds a first range (e.g., threshold) about a set point temperature. In some examples, the switching mechanism 104 can make and/or enable a connection (e.g., an electric connection) if the temperature of the heating device 106 falls within or below a second range of an acceptable set point temperature. In some examples, the second range may be the same as the first range. In some examples, the second range may be different than the first range. In some examples, the switching mechanism 104 can determine that a signal indicative of a temperature of the heating device 106 has exceeded an upper limit of a threshold. In these examples, the switching mechanism 104 can, by disabling transmission of the electric connection, disable transmission of the PWM signals and stop the heating device 106 from receiving signals (e.g., the PWM signals). Contrarily, if the switching mechanism 104 detects that the signals falls below a lower limit or second threshold, the switching mechanism 104 can enable the transmission of PWM signals by establishing the electric connection, which can transmit the PWM signals to the heating device 106.

In some examples, the switching mechanism 104 can receive PWM signals from the PID controller 102. The PWM signals can be received continuously from the PID controller 102 even when the switching mechanism 104 selectively disables the transmission of signals to the heating device 106. For example, the PID controller 102 can be unaffected by operation of the switching mechanism 104. In some examples, the system 100 can utilize the PID controller 102 to generate PWM signals for increasing a current temperature of a drying zone and/or heated pressure roller by increasing the temperature of the heating device 106. For example, an imaging device can utilize PWM signals generated by the PID controller 102 to increase a current temperature of the drying zone and/or heated pressure roller by increasing the temperature of the heating device 106.

The switching mechanism 104 can receive signals from the heating device 106. In some examples, the heating device 106 can be a heating zone utilized to generate heat for a drying zone, area of an imaging device, and/or device such as a heated pressure roller. In some examples, the signals received from the heating device 106 are directly proportional to the temperature of the heating device 106.

In some examples, the switching mechanism 104 can determine that the signals, received from the heating device 106, exceed a first threshold. A threshold can be a variation of an upper limit (e.g., a first threshold) and a lower limit (e.g., a second threshold) of a particular set point temperature. In some examples, the first threshold can be the upper limit for the set point temperature. In some examples, the second threshold can be a value that is above the set point temperature but below the first threshold. For example, the set point temperature for a print job can be set at 110 degrees Celsius (C). In this example, a corresponding upper limit can be the set point temperature plus 15 degrees. Thus, in this example, the first threshold temperature can be set to 125 degrees C.

The switching mechanism 104 can disable transmission of signals to the heating device 106 in response to the signals of the heating device 106 exceeding the first threshold. That is, the switching mechanism 104 can prevent the PWM signals from reaching the heating device 106 when the temperature of the heating device 106 exceeds the first threshold. The switching mechanism 104 can prevent the PWM signals from reaching the heating device 106 until the temperature of the heating device 106 falls below a second threshold. In response to detecting that the signals from the heating device 106 have indicated that the temperature of the heating device 106 has exceeded the first threshold, the switching mechanism 104 can selectively disable the PWM signals from reaching the heating device 106. The PWM signals cannot reach the heating device 106 when the switching mechanism 104 has selectively disabled the PWM signals. In some examples, the switching mechanism 104 can continue to prevent the PWM signals from reaching the heating device 106 until the temperature is within a second threshold.

In some examples, the switching mechanism 104 can include instructions to selectively enable the PWM signals when a real time temperature of the heating device 106 is within the second threshold temperature for the set point temperature. For example, the switching mechanism 104 can selectively enable the PWM signals when the real time temperature is above 10 degrees of the set point temperature (e.g., within the second threshold, etc.).

The switching mechanism 104 can selectively enable the PWM signals in response to the temperature of the heating device 106 reaching the second threshold. In some examples, when the temperature of the heating device 106 reaches the second threshold, the switching mechanism 104 can selectively enable, by completing a circuit to allow the PWM signals to reach the heating device 106. In some examples, the switching mechanism 104 can use logic to pass PWM signals to the heating device 106. In response to the PWM signals being enabled, the heating device 106 can receive the PWM signals and function in response to the received PWM signals.

In some examples, the switching mechanism 104 can be placed in between the PID controller 102 and the heating device 106. Thus, the switching mechanism can act as a gateway between the PID controller 102 and the heating device 106. A temperature sensor can be communicatively coupled to the switching mechanism 104 and the PID controller 102. The temperature sensor can provide temperature signals from within the heating device 106. Real time temperature of the heating device 106 can be received by the switching mechanism 104 and the PID controller 102 via the temperature sensor.

Figure 2:
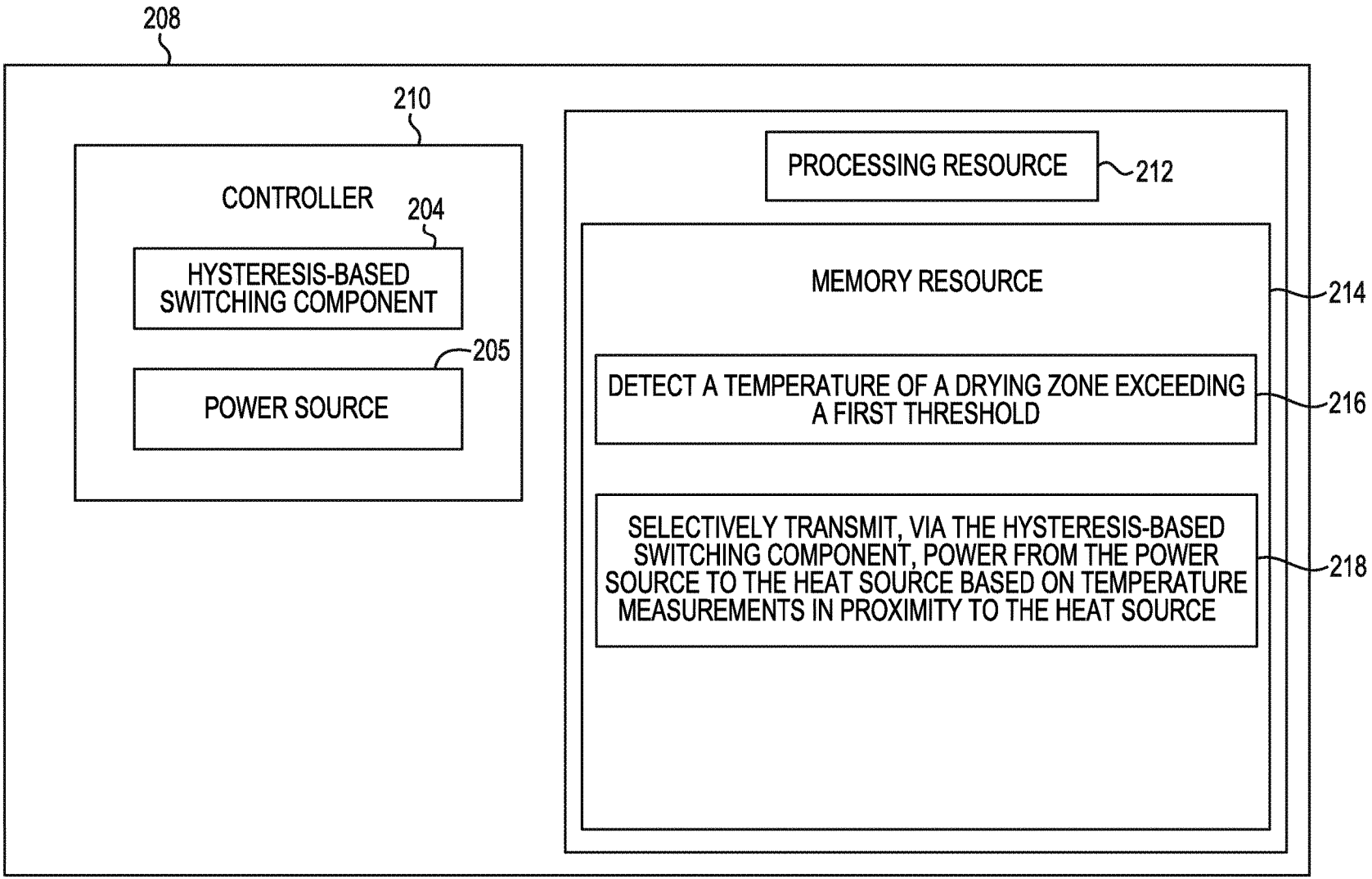
FIG. 2 illustrates a block diagram of an imaging device according to an example.

FIG. 2 illustrates a block diagram of an imaging device 208 according to an example. The imaging device 208 can include a controller 210, a memory resource 214 and a processing resource 212. In some examples, the memory resource 214 may be communicatively coupled to the processing resource 212, which can be a central processing unit (CPU), a semiconductor-based microprocessor, and/or other hardware devices suitable for retrieval and execution of instructions 216 and 218 stored in the memory resource 214 (e.g., in a non-transitory computer readable medium). The example processing resource 212 may fetch, decode, and execute instructions. As an alternative, or in addition to, retrieving and executing instructions, the example processing resource may include an electronic circuit that may include electronic components for performing the functionality of executed instructions.

The imaging device 208 can be an inkjet imaging device. As used herein, an inkjet imaging device can deposit a print substance (e.g., liquid ink, etc.) on a print media (e.g., paper, etc.). In some examples, the print substance can be absorbed into the print media, which can cause distorted properties (e.g., curd, cockle, etc.). In some examples, the imaging device 208 can utilize a drying zone to remove or reduce excess moisture and/or distorted properties from partially dried inkjet media (e.g., media with deposited print substance from the imaging device 208, etc.).

In some examples, the controller 210 of the imaging device 208 can receive PWM signals from a PID controller (e.g., PID controller 102 as referenced in FIG. 1, etc.), and also receive a signal from the drying zone of the imaging device 208 that indicates a current temperature of the drying zone. The signals of the drying zone can be directly proportional to the temperature of the drying zone. In some examples, the controller 210 of the imaging device 208 can determine a temperature difference between a real time temperature of the drying zone and a set point temperature. In some examples, the controller 210 can determine the temperature difference between the real time temperature and the set point temperature to bring the real time temperature below an upper limit of the set point temperature.

The memory resource 214 may store instructions 216 executable by the processing resource 212 to cause the imaging device 208 to detect a temperature of a drying zone exceeding a first threshold. In some examples, the first threshold can be the upper limit for a set point temperature. For example, the set point temperature for a print job can be set at 110 degrees C. and the corresponding upper limit can be the set point temperature plus 15 degrees C. In such an example, the processing resource 212 can cause the imaging device 208 to detect a temperature of a drying zone exceeding the first threshold of 125 degrees C.

The memory resource 214 may store instructions 218 executable by the processing resource 212 to cause the imaging device 208 to selectively transmit, via the hysteresis-based switching component, power from the power source to the heat source based on temperature measurements in proximity to the heat source. In some examples, the instructions 218 can include instructions to disable transmission of power to the heat source or drying zone of the imaging device. For example, the controller 210 can disable power from the power source 205 from reaching the heat source or drying zone. In some examples, the memory resource 214 can include instructions to enable transmission of the power to the heat source responsive to a determination that the real time temperature of the drying zone is within a second threshold of a set point temperature.

In some examples, the memory resource 214 may store instructions executable by the processing resource 212 to disable, via a switching mechanism, transmissions of PWM signals in response to the temperature exceeding the first threshold while continuing to receive the PWM signals from the PID controller. In some examples, in response to exceeding the first threshold of 125 degrees C., the processing resource 212 can cause the imaging device 208 to disable the transmission of PWM signals to prevent the PWM signals from reaching the drying zone.

In some examples, the processing resource 212 can cause the imaging device 208 to receive the PWM signals from a PID controller, even if the temperature exceeds the first threshold. In some examples, the PID controller continues to generate PWM signals and transmit PWM signals to the controller 210 despite the temperature of the drying zone exceeding the first threshold. For example, the PID controller can continue to generate PWM signals by applying a particular voltage at a particular frequency or a particular percentage of time on versus time off in a given time period to the controller 210 in attempts to increase the temperature of the drying zone. However, the PWM signals can be prevented from reaching the drying zone by the controller 210 when the temperature of the drying zone exceeds the threshold. Thus, the PWM signals remain intact (e.g., continues to be generated, continues to be active) even when the PWM signals are selectively disabled by the controller 210.

The memory resource 214 may store instructions executable by the processing resource 212 to cause the imaging device 208 to allow the temperature of the drying zone to alter to a second threshold while the PWM signals are selectively disabled by the controller 210. The second threshold can be a value that is above the set point temperature but below the first threshold. For example, the set point temperature for a print job can be set at 110 degrees and the corresponding lower limit can be the set point plus 10 degrees. Thus, a second threshold temperature can be 120 degrees C. when the set point temperature for the print job is set to 110 degrees C.

In some examples, the controller 210 can include a hysteresis-based switching component 204 (e.g., switch, switching mechanism, etc.) to disable the PWM signals. As described herein, the hysteresis-based switching component 204 can break and/or disable an electric connection if the temperature of the drying zone reaches the first threshold. In some examples, the hysteresis-based switching component 204 can make and/or enable an electric connection if the temperature of the drying zone reaches the range of an acceptable set point temperature. In some examples, the hysteresis-based switching component 204 can be a feedback switch that can switch between two states, on and off. In some examples, the controller 210 can include a power source 205 that can provide electrical power and/or electrical signals to the drying zone of the imaging device 208. In some examples, the transmission of the PWM signals from a PID controller is selectively enabled and disabled via the hysteresis-based switching component 204.

In some examples, the hysteresis-based switching component 204 can be utilized to transmit power from the power source to a heat source or drying zone based on temperature measurements in proximity to the heat source. Thus, the controller 210 can selectively transmit power from the power source 205 based on the real time temperature of a drying zone and/or heat source associated with a drying zone. In some examples, the controller 210 can selectively transmit power in the same or similar way as referenced with PWM signals. For example, the hysteresis-based switching component 204 can enable electrical power from the power source 205 to transmit to a drying zone or heat source when the temperature of the heat source is below a second threshold.

Figure 3:
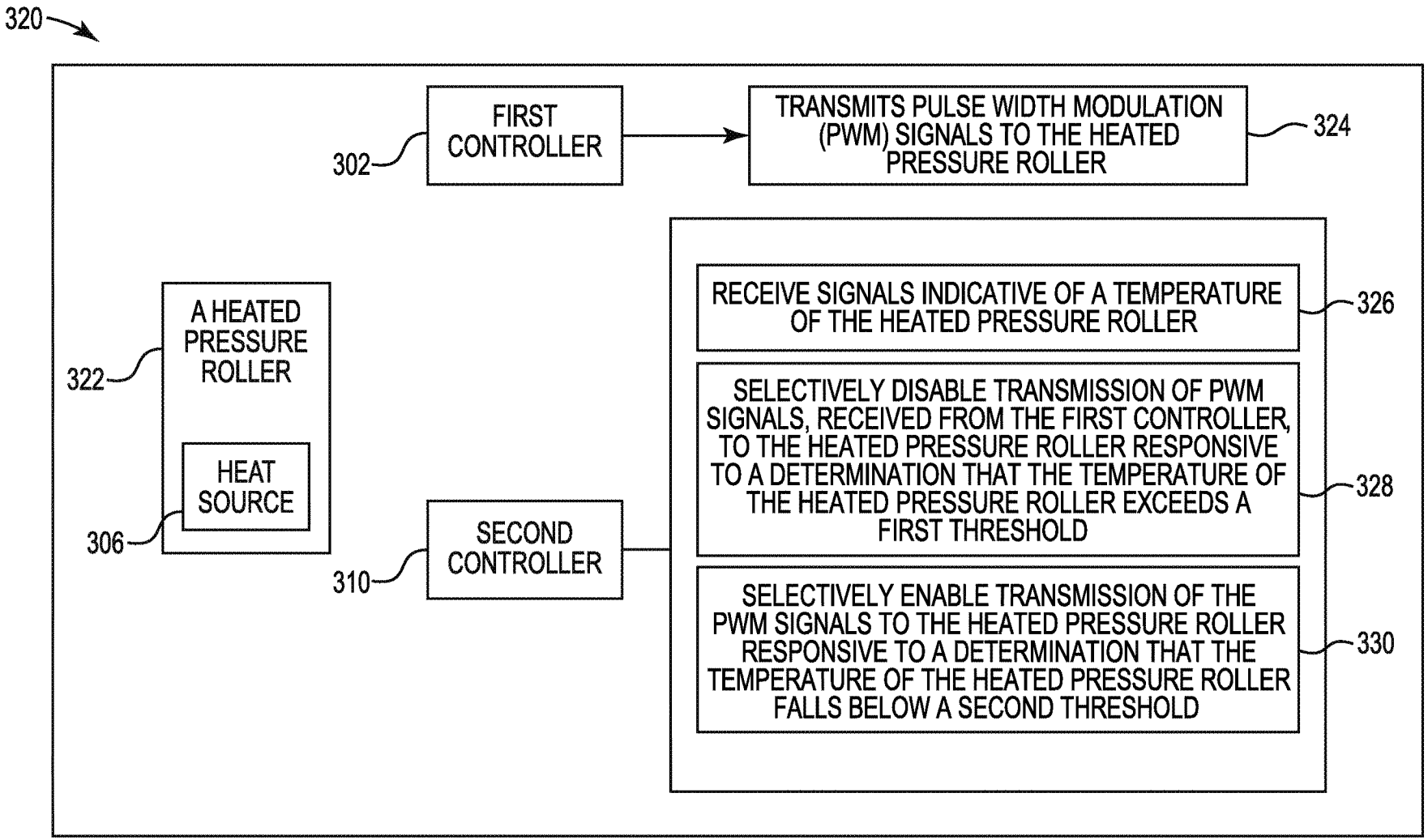
FIG. 3 illustrates a system according to an example.

FIG. 3 illustrates a system 320 according to an example. The system 320 can include a heated pressure roller 322 comprising a heat source 306, a first controller 302, and a second controller 310. The heated pressure roller 322 can receive partially dried inkjet media from a print zone. The first controller 302 of system 320 can be a PID controller. The second controller 310 of system 320 can be a controller that includes a switching mechanism (e.g., controller 210 as referenced in FIG. 2, etc.). It is noted that even though first controller 302 and second controller 310 are illustrated as being distinct controllers, in one implementation they may be combined in whole or in part.

The first controller 302 can generate PWM signals. For example, the first controller 302 can transmit PWM signals to the heated pressure roller 322, as illustrated by block 324. The first controller 302 can use a control loop feedback mechanism to continuously modulate the PWM signals. In some examples, the PWM signals can be received by the second controller 310. In some examples, the second controller 310 can receive a signal (e.g., temperature value, etc.) from the heated pressure roller 322, as illustrated by block 326. In some examples, the first controller 302 can transmit PWM signals to the heated pressure roller 322, as illustrated by block 324, to alter a temperature of the heated pressure roller 322.

In some examples, the heated pressure roller 322 can include heat source 306. In some examples, the heat source 306 can be positioned within the heated pressure roller 322 to receive power from the first controller 302 through the second controller 310 to generate a corresponding quantity of heat based on the received PWM signals generated by the first controller 302. In some examples, the rate of temperature increase of the heated pressure roller 322 can correspond to a numerical value representative of PWM signals generated by the first controller 302. For example, as the PWM value increases, an amount of heat applied to the heated pressure roller 322 can increase. This, in turn, can lead to an increase in temperature of the heated pressure roller 322 at a relatively higher rate compared to a comparatively lower PWM value (e.g., prior to increases).

In some examples, the second controller 310 can be positioned to receive the PWM signals from the first controller 302 and temperature information from the heated pressure roller 322. The second controller 310 can include a processing resource, similar to processing resource 212 as referenced in FIG. 2, to execute instructions 326, 328, and/or 330.

The processing resource of the second controller 310 can execute instructions 326 to cause the second controller 310 to receive signals indicative of a temperature of the heated pressure roller 322. In some examples, the signals can include numerical values that represent a current temperature of the heated pressure roller 322.

The processing resource of the second controller 310 can execute instructions 328 to cause the second controller 310 to selectively disable transmission of PWM signals, received from the first controller 302, to the heated pressure roller 322 responsive to a determination that the temperature of the heated pressure roller 322 exceeds a first threshold. The second controller 310 can keep the PWM signals disabled and prevent the transmission of the PWM signals from reaching the heated pressure roller 322. In some examples, the PWM signals can remain disabled until the temperature of the heated pressure roller 322 is adjusted and/or the temperature reaches a second threshold.

The processing resource of the second controller 310 can execute instructions 330 to cause the second controller 310 to selectively enable transmission of the PWM signals to the heated pressure roller 322 responsive to a determination that the temperature of the heated pressure roller 322 falls below the second threshold. As described herein, the first threshold can be an upper limit that can be a first quantity greater than a set point temperature of a print job and the second threshold can be a lower limit that can be a second quantity greater than the set point temperature of the print job. For example, the first quantity can be 15 degrees and the second quantity can be 10 degrees.

As described herein, the first controller 302 can continue to generate PWM values and continue to transmit the generated PWM values to the second controller 310 even when the second controller has selectively disabled the transmission of the PWM signals to the heated pressure roller 322. In some examples, the generated PWM signals from the first controller 302 can be more accurate (e.g., having a more precise PWM value) when the second controller selectively enables the transmission of the PWM signals to the heated pressure roller 322 compared to systems that stop the first controller 302 from generating PWM signals when the second controller 310 selectively disables transmission of the PWM signals. For example, previous systems utilized a seeding PWM value when a controller similar to the first controller was reactivated after a period of time. In this way, the first controller 302 can utilize historic temperature values for the heated pressure roller 322 during the time when the second controller 310 has selectively disabled the transmission of PWM signals to the heated pressure roller 322, which may allow for a PWM value to be up-to-date and therefore more accurate than a previously known PWM value or a seeding PWM value.

Figure 4:
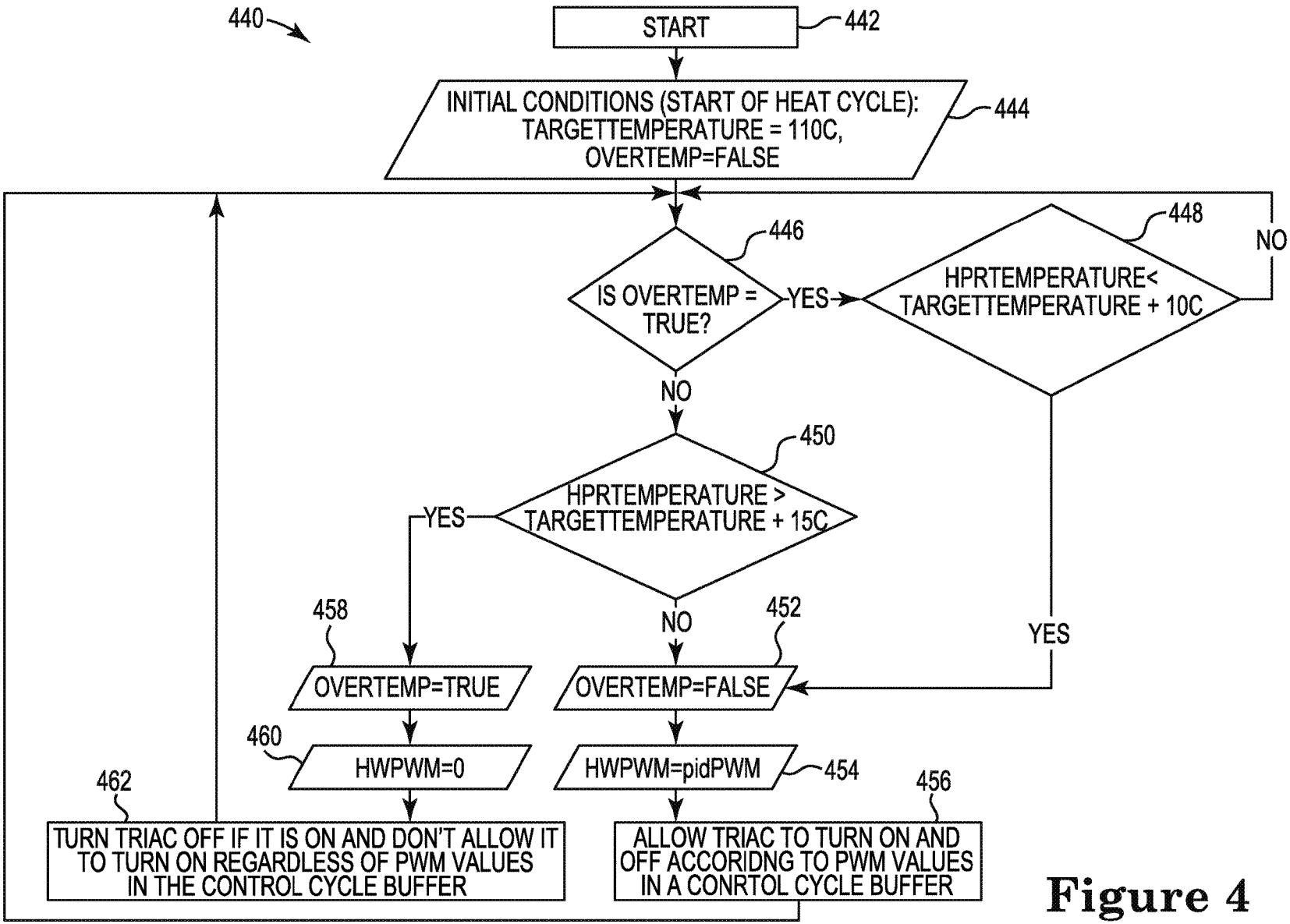
FIG. 4 illustrates a pulse width modulation control process according to an example.

FIG. 4 illustrates a pulse width modulation control process 440 according to an example. The process 440 as illustrated in FIG. 4 can be a method that can be executed by a computing device, controller, and/or other type of device associated with an imaging device. For example, the process 440 can be stored as instructions in a non-transitory machine readable medium and executed by a processor to perform the elements of the process 440.

FIG. 4 illustrates a current print job start at 442. As described herein, the starting time for a print job can be when an imaging device begins to process a print job. That is, the print job start at 442 can represent a time when the imaging device initiates the print process to generate an image on the print media. At this time, the imaging device can begin to determine current temperatures of the drying zone and/or heated pressure roller.

At 444, the process 440 can include setting the initial state of the drying zone and/or heated pressure roller. Setting the initial state can include setting the drying zone set point temperature and the threshold for the specific print job. For example, at 444 the process 440 can set the set point temperature of the drying zone at 110 degrees C., set the first threshold temperature to the set point temperature plus 15 degrees, and set the second threshold to the set point temperature plus 10 degrees. Also, at 444 the process 440 can set the process variable to false.

At 446, the process 440 can include determining a process variable (e.g., stored as signals or states) related to the drying zone temperature exceeding a threshold is true. For example, if a heated pressure roller is determined to exceed an upper limit of a setpoint, signals or states may be stored to the process variable (e.g., OVERTEMP) to indicate the fact that the upper limit has been exceeded (e.g., OVERTEMP=TRUE). In some examples, the value would be determined true if the temperature has exceeded the first threshold during the current print job or heat cycle. In some examples, the value would be false if the temperature exceeded the second threshold but did not exceed the first threshold during the current print job or heat cycle. Thus, at 446, the process 440 can determine whether the variable is set to "TRUE". It is noted that in some cases, other values may be used rather than a binary "TRUE" or "FALSE" to indicate that an upper limit has been exceeded (e.g., "1," "0," etc.).

At 448, the process 440 can determine if the temperature of the heated pressure roller is below a second threshold when the answer to 446 is yes. In some examples, a flow control variable is set up. The flow control variable can indicate whether a heat source has exceeded a first threshold at any point and has not passed through the second threshold. For example, if a temperature of a heat source previously exceeded the first threshold and the process variable stored as "TRUE," the determination at 448 may be used to determine whether the temperature of the heat source has subsequently decreased below (e.g., or at or below in some cases) the second threshold. If so, example process 440 may advance to 452; otherwise, example process 440 may return above 446 (e.g., and loop between 446 and 448 until the temperature drops below the second threshold).

At 450, the process 440 can determine if the temperature of the heated pressure roller is greater than the first threshold when the answer to 446 is no. That is, the process 440 can move to 450 when the process variable (e.g., OVERTEMP) is false. That is, at 450 the process 440 can determine if the temperature of the heated pressure roller exceeds the upper limit/first threshold. For example, the temperature of the heated pressure roller can be 130 degrees C., which is greater than the set point temperature of 110 degrees C. plus the first threshold temperature of 15 degrees, as described above.

At 452, the process 440 can set the process variable (e.g., OVERTEMP) of the heated pressure roller to "FALSE" when the answer to 448 is yes.

At 454, the process 440 can set a Hardware Pulse Width Modulation (HWPWM) parameter to the PID determined PWM. In some examples, the process 440 can move to 456 to allow a TRIAC to turn on and off according to the PWM values in a control cycle buffer. The control cycle buffer can be a hardware register that can contain PWM values, which may be used to generate (e.g., provide) PWM signals to the heated pressure roller. Once the process 440 has completed 456, the process 440 can move back to 446 to determine if the process variable is true.

At 452, the process 440 will set the process variable of the heated pressure roller to false when the answer to 450 is no. For example, at 450 the process 440 can determine that the temperature has not exceeded the first threshold. That is, at 452, the process 440 can set the process variable of the heated pressure roller to "FALSE".

At 458, the process 440 will set the process variable of the heated pressure roller to "TRUE" when the answer to 450 is yes.

At 460, the process 440 can set the HWPWM parameter to the value of 0. The process 440 can move to 462 to turn the TRIAC off if it is on and don't allow the TRIAC to turn on regardless of the PWM values in the control cycle buffer. In some examples, this can prevent the imaging device from significantly overheating. Once the process 440 has completed 462, the process 440 can move back to 446 to determine that the process variable is true.

In the foregoing detailed description of the disclosure, reference is made to the accompanying drawings that form a part hereof, and in which is shown by way of illustration how examples of the disclosure can be practiced. These examples are described in sufficient detail to enable those of ordinary skill in the art to practice the examples of this disclosure, and it is to be understood that other examples can be utilized and that process, electrical, and/or structural changes can be made without departing from the scope of the disclosure.

The figures herein follow a numbering convention in which the first digit corresponds to the drawing figure number and the remaining digits identify an element or component in the drawing. Similar elements or components between different figures can be identified by the use of similar digits. For example, 221 can reference element "21" in FIG. 2, and a similar element can be referenced as 321 in FIG. 3. Elements shown in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense.

What is claimed:

1. A system comprising:

a heating device in a drying zone of an imaging device to generate heat in the drying zone for a print medium;

a Proportional Integral Derivative (PID) controller; and a switching mechanism to:

selectively disable transmission of signals in response to a determination that a real time temperature in proximity to the heating device exceeds a first threshold, wherein the first threshold comprises an upper limit for a set point temperature of the heating device;

selectively enable the transmission of signals to the heating device in response to a determination that the real time temperature falls below a second threshold;

wherein:

the second threshold includes a lower limit for a set point temperature and is greater than the set point temperature for the heating device; and the PID controller is to continuously output pulse width modulation (PWM) signals independent of selective transmission of signals by the switching mechanism.

2. The system of claim 1, wherein the switching mechanism comprises a hysteresis-based switching component.

3. The system of claim 1, wherein the signals to include electrical power transmitted to the heating device.

4. The system of claim 1, wherein the signals to include PWM signals generated by the PID controller.

5. The system of claim 1, wherein the PID controller to be unaffected by operation of the switching mechanism.

6. An imaging device comprising:

a controller comprising a hysteresis-based switching component and a power source with a feedback loop to provide power to a heat source in a drying zone of the imaging device to generate heat in the drying zone for a print medium;

a non-transitory computer readable medium storing instructions executable by a processing resource to:

detect a temperature of a drying zone exceeding a first threshold;

selectively disable transmission of signals in response to a determination that a temperature in proximity to the heat source exceeds a first threshold, wherein the first threshold comprises an upper limit for a set point temperature of the heat source; and selectively enable the transmission, via the hysteresis-based switching component, of power from the power source to the heat source in response to a determination that the temperature in proximity to the heat source falls below a second threshold based;

wherein the second threshold includes a lower limit for a set point temperature and is greater than the set point temperature for the heat source.

7. A system, comprising:

a heated pressure roller to receive partially dried inkjet media from a print zone, wherein the heated pressure roller includes a heat source in a drying zone of an imaging device to generate heat in the drying zone for a print medium;

a first controller, wherein the first controller transmits Pulse Width Modulation (PWM) signals to the heated pressure roller, wherein the first controller to continue to transmit PWM signals while transmission of PWM signals is selectively disabled by a second controller; and the second controller to receive the PWM signals from the first controller, the second controller to:

receive signals indicative of a temperature of the heated pressure roller;

selectively disable transmission of PWM signals, received from the first controller, to the heated pressure roller responsive to a determination that the temperature of the heated pressure roller exceeds a first threshold; and selectively enable transmission of the PWM signals to the heated pressure roller responsive to a determination that the temperature of the heated pressure roller falls below a second threshold;

wherein the first threshold is greater than the second threshold and the second threshold is greater than a set point.

8. The system of claim 7, wherein the transmission of the PWM signals is selectively enabled and disabled via a hysteresis-based switching component.

* * * * *